United States Patent [19]

Kozlow et al.

[11] 4,284,167

[45] Aug. 18, 1981

[54] SOUND REPRODUCING DEVICE

[75] Inventors: Ronald R. Kozlow, Morristown; Donald D. Grieg, North Bergan, both of N.J.

[73] Assignee: Electronic Research Assoc., Inc., Moonachie, N.J.

[21] Appl. No.: 44,869

[22] Filed: Jun. 4, 1979

[51] Int. Cl.[3] ..... H04R 7/20

[52] U.S. Cl. ..... 181/172; 181/173

[58] Field of Search ..... 181/171, 172, 173, 179; 179/115.5 R

[56] References Cited

U.S. PATENT DOCUMENTS

| | | | |
|---|---|---|---|
| 1,773,910 | 8/1930 | Lane | 181/173 |
| 2,069,242 | 2/1937 | Graham | 181/172 |
| 2,439,666 | 4/1948 | Marquis | 181/172 |
| 2,490,466 | 12/1949 | Olson et al. | 181/172 |
| 2,630,189 | 3/1953 | Julie | 181/172 |
| 3,019,849 | 2/1962 | King | 181/172 |
| 3,351,719 | 11/1967 | Schoengold | 181/171 X |
| 3,531,602 | 7/1970 | Brown | 179/115.5 R |
| 3,925,626 | 12/1975 | Stallings, Jr. | 179/115.5 R |

*Primary Examiner*—L. T. Hix
*Assistant Examiner*—Benjamin R. Fuller
*Attorney, Agent, or Firm*—Lerner, David, Littenberg & Samuel

[57] ABSTRACT

An improved sound reproducing device which includes a housing, an acoustic diaphragm and drive means for driving the acoustic diaphragm. Corrugated compliant coupling means is provided for supporting the acoustic diaphragm with respect to the housing in a predetermined lateral position for longitudinal movement relative thereto. The compliant coupling means has a lateral cross-sectional shape which is noncircular so that the acoustic diaphragm is centered in a predetermined lateral position but which allows freedom of movement in the longitudinal direction. The drive means provides the relative longitudinal movement between the acoustic diaphragm and the housing. In a preferred embodiment, the corrugated compliant coupling has a rectangular cross-sectional shape.

18 Claims, 3 Drawing Figures

SOUND REPRODUCING DEVICE

BACKGROUND OF THE INVENTION

The present invention relates to sound reproducing equipment such as loudspeakers and the like which are light in weight, economical to produce, and which possess improved acoustical characteristics. More particularly, the invention is directed to sound reproducing equipment in which the acoustic diaphragm is compliantly mounted with respect to a housing for relatively free longitudinal movement, while being maintained in a predetermined lateral position.

Various suspension systems have been designed in an attempt to increase the power handling capabilities of loud speakers without correspondingly increasing the distortion introduced due to the suspension system. In this regard, it is desired for maximizing acoustic power radiated to provide for increased diaphragm excursions for a given frontal area of the diaphragm. Examples of such prior art systems are disclosed in U.S. Pat. No. 2,439,666 to Marquis, U.S. Pat. No. 2,490,466 to Olson et al, and U.S. Pat. No. 3,019,849 to King.

In these prior art systems, the loudspeakers employ cone shaped diaphragms which are compliantly supported within the loudspeaker frame or housing. The diaphragm carries a voice coil and voice coil form which is arranged within an air gap provided by a permanent magnet assembly which serves as a driving force for causing excursion of the diaphragm. In these prior art arrangements, compliant supporting members support both the enlarged peripheral portion of the cone shaped diaphragm as well as the small end of the diaphragm which carries the voice coil form and voice coil. In other words, both the outer peripheral edge of the diaphragm as well as the centrally located portion are supported relative to the frame by compliant members which serve to center the diaphragm (for proper orientation of the voice coil within the air gap provided in the magnetic assembly) and to allow free longitudinal or axial movement of the diaphragm. For example, in both the Marquis and Olson et al references, these compliant supports are provided by a pair of corrugated compliant ring members which are corrugated transverse relative to the direction of longitudinal movement. That is, the compliant coupling members are each a laterally extending ring having a plurality of ridges or corrugations extending out of the plane thereof. Such compliant members are designed to limit radial or lateral motion of the diaphragm while permitting movement in the longitudinal direction as a result of bending of the ring members. In the King patent, the compliant member at the small end of the frustro-conical diaphragm (commonly known as a spider) is of the conventional laterally extending ring type which may comprise a spring or laterally extending ring elements having ridges extending out of the plane thereof, as in the Marquis or Olson et al references. On the other hand, the compliant member at the peripheral base portion in the King patent comprises a circular bellows type corrugated compliant member which is corrugated in the longitudinal direction so as to permit longitudinal movement in the manner of an accordian.

One problem of the prior art has been the necessity of compliant members which extend and are attached laterally to the speaker housing to provide for the necessary lateral stability of the support system to maintain the proper alignment of the voice coil relative to the magnet driving assembly. In the Marquis and Olson et al references, such laterally extending compliant members were attached at both the peripheral base portion and the small end of the cone shaped diaphragm, whereas in the King reference such a compliant member was only provided at the small end of the cone shaped diaphragm. Such arrangements limit the frequency response capable of being achieved for a given speaker size, as well as introducing distortion into the system as a result of edge type reflection due to the radial or lateral connection of the compliant members to the loudspeaker housing.

Another problem of the prior art arrangements has been that the compliant support for supporting the diaphragm encroaches upon the area of the diaphragm, thus limiting the effective area of the radiating surface for a given housing size. This is readily apparent from the structures shown in the Olson et al and Marquis patents, in which the radially extending rings circumferentially surround the peripheral edges of the diaphragm and are located between the frame and the edge of the diaphragm. The King patent attempts to overcome this problem by utilizing an axially extending corrugated compliant member for the outer peripheral portion of the diaphragm. However, it is to be noted that the outer peripheral edge of the diaphragm is attached to or between a pair of corrugations. Thus, while this structure does reduce the amount of encroachment on the effective radiating area, it still encroaches on that area.

These and other disadvantages of the prior art are overcome with the present invention.

SUMMARY OF THE INVENTION

The present invention is directed to an improved sound reproducing device which comprises a housing, an acoustic diaphragm, and drive means for driving the acoustic diaphragm. Corrugated compliant coupling means is provided for supporting the acoustic diaphragm with respect to the housing in a predetermined lateral position for longitudinal movement relative thereto. The compliant coupling means has a lateral cross-sectional shape which is noncircular so that the acoustic diaphragm is centered or aligned in a predetermined lateral position with respect to the housing. The compliant coupling means allows freedom of movement of the acoustic diaphragm in the longitudinal direction relative to the housing, and the drive means serves to drive the acoustic diaphragm in such movement. Therefore, a separate supporting means for maintaining the lateral positioning is not required with the present invention.

In a preferred embodiment, the corrugated compliant coupling has a lateral cross-sectional shape which includes a substantially straight or linear portion which aids in resisting lateral movement of the coupling. In a still further preferred embodiment, the cross-sectional shape of the compliant coupling is polygonal, and still further, is preferably rectangular with square corners.

In a still further preferred embodiment, the acoustic diaphragm includes a front, substantially planar face and a back face, and a first end of the compliant corrugated coupling means is connected to the back face and has its corrugations extending rearwardly substantially normal to the planar front surface. The housing or frame for the sound reproducing device includes a rear wall, and a second end of the compliant coupling means is connected to such rear wall. In this way, the compliant coupling means does not encroach upon the radiating surface area of the diaphragm, thus permitting maximization of the effective radiating area for a given frame size.

In a further preferred embodiment, the magnetic driving structure is encompassed within the boundaries of the compliant coupling, thus reducing the overall dimensions of the overall structure.

These and further features and characteristics of the present invention will be apparent from the following detailed description in which reference is made to the enclosed drawings which illustrates the preferred embodiments of the present invention.

DETAILED DESCRIPTION OF THE PREFERRED EMBODIMENT

Figure 1:
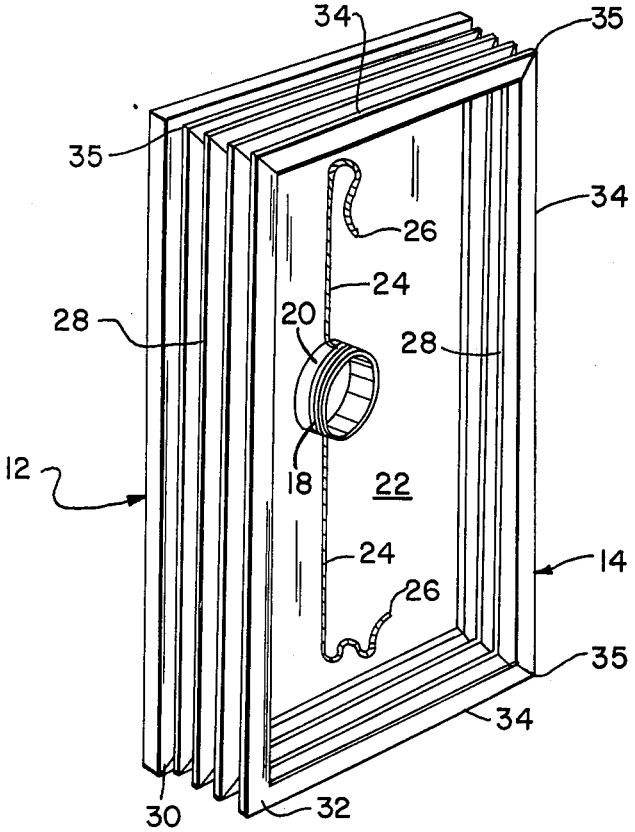
FIG. 1 is a perspective view of an acoustic diaphragm and corrugated compliant coupling for a sound reproducing device in accordance with the present invention.

Referring now to the drawings in which like reference characters represent like elements, there is shown in FIG. 1 an acoustic diaphragm 12 and compliant supporting member 14 for use in a sound reproducing device 10 (see FIG. 2) in accordance with the principles of the present invention. In a preferred embodiment, the acoustic diaphragm 12 is formed of strong stiff expanded cellular plastic material such as polystyrene of extremely low density. Preferably, although not necessary, the diaphragm 12 is substantially planar or flat in form. Further, in a preferred embodiment, the acoustic diaphragm 12 is rectangular in shape although other shapes can be used in accordance with the present invention, such as for example that which will be described hereinbelow with respect to FIG. 3.

A voice coil 18 of the sound reproducing device 10 is securely mounted on a voice coil form 20 which preferably consists of a thin, lightweight tube made of plastic, coated paper, aluminum, or the like and centrally secured to the rear surface 22 of the planar acoustic diaphragm 12. For example, the voice coil form 20 may be fixably secured to the diaphragm 12 by being embedded in the molded material of which the diaphragm is formed. Electrical leads 24 are connected to the voice coil 18 and extend laterally outward from the voice coil form 20 along the rear surface 22 of the acoustic diaphragm 12. The laterally extending portions of the leads 24 are secured to the surface 22 of the diaphragm 12 so as to be fixably held in place to prevent damage thereto or relative movement thereof during vibration of the diaphragm 12. Alternatively, the leads 24 could be embedded in the material of which the diaphragm 12 is formed. The ends 26 of the leads 24 are adapted for suitable connection with an actuating circuit of any conventional type. Further, although not shown, the leads 24 may be folded over onto themselves to allow for freedom of axial movement of the diaphragm 12.

For flexibly supporting the acoustic diaphragm 12 (and voice coil 18) with respect to a loudspeaker housing or frame 16, there is provided in accordance with the present invention a corrugated compliant coupling member 14. The corrugated compliant coupling 14 is provided with a plurality of corrugations or pleats 28 which extend in a manner to permit axial or longitudinal movement of the acoustic diaphragm 12 to and fro relative to the loudspeaker housing 16 (see FIG. 2). For the purposes of discussion herein, these corrugations 28 will be referred to as extending longitudinally, or at right angles to the plane of the diaphragm 12. One end 30 of the corrugated compliant coupling 14 is connected to the rear face 22 of the planar diaphragm 12 and the other end 32 is adapted to be connected to the loudspeaker housing or frame 16 (see FIG. 2). Thus, the corrugated coupling 14, and therefore the diaphragm 12, are free to move longitudinally as the corrugations 28 extend and retract in the longitudinal direction, in the manner of an accordian or bellows.

The corrugated compliant coupling member 14 in accordance with the present invention, has a noncircular cross-sectional shape which serves to provide lateral stability to properly position and maintain the acoustic diaphragm 12 in proper lateral position within the loudspeaker housing or frame 16. It is to be realized that the noncircularity is important as same tends to resist forces tending to cause lateral movement or displacement of the compliant coupling 14 and thus of the acoustic diaphragm 12. That is, forces which might otherwise tend to move the corrugated support member 14 and diaphragm 12 laterally within the housing 16 are resisted as a result of the noncircularity. In this regard, the compliant coupling 14 preferably includes at least one straight or linear section 34 which further benefits this resistance. In a preferred embodiment, the cross-sectional shape is rectangular having four square corners 35 and four linear sections 34. However, other polygonal cross-sectional shapes may also be used.

Figure 2:
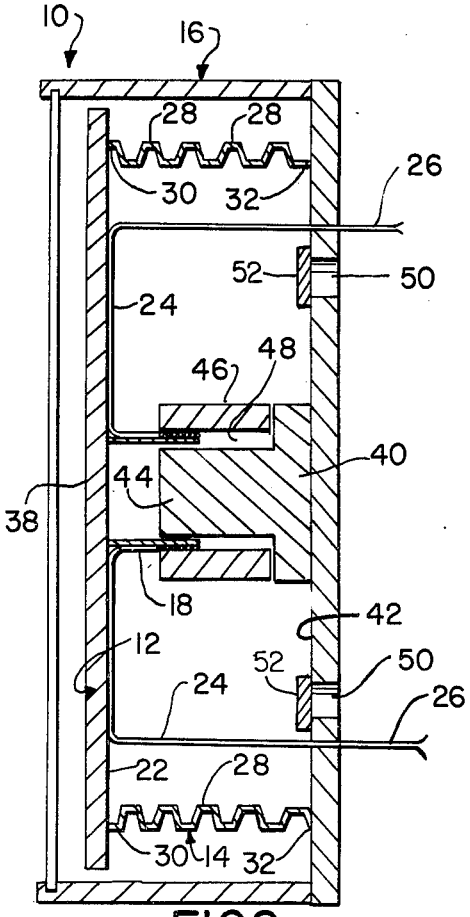
FIG. 2 is a side sectional view of a sound reproducing device in accordance with the present invention with the diaphragm and corrugated compliant coupling disposed within a housing and supported in relation to a drive means therefor.

Thus, the compliant coupling member 14, with its corrugations 28 extending longitudinally, allows for freedom of movement of the diaphragm 12 in the longitudinal direction relative to the housing or frame 16, and also maintains the desired lateral positioning thereof. As best seen in FIG. 2, the lateral dimensions of the compliant coupling member 14 may be such that the coupling member 14 is connected near the outer peripheral edges of the diaphragm 12. In the preferred embodiment, one end 30 of the coupling member 14 is secured to the rear surface 22 of the planar diaphragm so that the compliant coupling member 14 does not encroach upon the radiating surface area of the front face 38. Thus, the only limitation on the size of the diaphragm 12 is the size of the opening within the loudspeaker frame 16. In other words, the lateral dimensions of the diaphragm 12 may be chosen to substantially correspond to the inner dimension of the loudspeaker frame 16. This allows for maximization of the radiating area and thus of the power capibilities of the diaphragm 12 for a given frame size. Further, the number of corrugations 28 can be chosen to permit the maximum diaphragm excursion capibilities consistent with the depth of the frame 16. This also serves to maximize the radiating power capibilities of the diaphragm 12 of the sound reproducing assembly 10.

The loudspeaker housing 16 includes a centrally located driving magnet assembly 40 fixably supported to the rear end wall 42 of the housing 16. The magnet assembly 40 includes a central pole piece 44 and outer annular pole pieces 46 defining a air gap 48 in which the voice coil 18 on the voice coil form 20 of the diaphragm 12 is located. Such a construction, as is well known in the art, provides the desired magnetic flux in the air gap 48 for driving of the diaphragm 12 relative to the housing 16 when the voice coil 18 is actuated to reproduce sound. It is to be noted that it is desired to maintain the axial alignment of the voice coil 18 within the air gap 48 in order to prevent distortion in the reproduced sound. This axial alignment, with the present invention, is achieved as a result of the single corrugated compliant coupling 14 having a noncircular cross-sectional shape. As noted above, the corrugations 28 provide for relatively free longitudinal movement of the diaphragm 12, and the noncircular shape provides the lateral stiffness required to maintain the axial alignment of the voice coil 18 with the driving magnet assembly 42. In this regard, it should be noted that even when the compliant coupling 14 is sized to be connected to the diaphragm 12 at the outer peripheral edges, it is not necessary to provide a centrally located compliant member in the vicinity of the voice coil 18 for maintaining the desired axial alignment.

This arrangement of the present invention of only a single compliant coupling 14 thus minimizes the dynamic distortion problems which are otherwise experienced with other types of systems employing laterally extending compliant members. Further in this regard, it should be noted that edge reflections, inherent in the arrangements of the prior art having laterally extending spiders in the vicinity of the voice coil and magnet assembly, as well as at the outer peripheral edge of the diaphragm, can be eliminated or at least minimized with the present invention, as the diaphragm 12 is only constrained at the ends of its longitudinal movement. Further still, it is to be noted that the driving magnetic assembly 40 is encompassed completely within the corrugations 28 of the complianct coupling 14. This thus permits the longitudinal dimensions or thickness of the speaker device 10 to be minimized, being dependent namely on the number and size of corrugations 28 of the compliant coupling 14.

Further, as seen in FIG. 2, the electric leads 24 connected to the voice coil 18 may extend in any suitable manner along the rear face 22 of the loudspeaker housing 16 to be connected to appropriate actuating equipment. Further still, air release openings 50 may be provided in the rear wall 38 of the housing 16. The air release openings 50 may be screened with suitable material, such as for example fiberous paper or cloth 52, which prevents dust and particles from contaminating the internal structure of the speaker 10, but at the same time permits free air entry and release.

In the preferred embodiment, the corrugated compliant coupling 14, as with the acoustic diaphragm 12, is preferably made of a lightweight polystyrene or other plastic material which is relatively hard and stiff but very light in weight. This allows for reducing the power requirements for actuating the sound reproducing equipment while maintaining the quality of the sound reproduced. Further, because of the large radiating area and the excursion capibilities, good sound reproducing quality with minimal distortion can be achieved with smaller sized loudspeaker systems and lower power requirements.

In a preferred embodiment, the corrugated compliant coupling member 14 is secured to the diaphragm 12, as well as to the housing 16, with a suitable cement or other adhesive. However, depending on the nature of the materials, the compliant coupling 14 could be integrally formed with the diaphragm 12 or the housing 16.

The exact configuration of the compliant coupling member 14 is determined by setting the distance between the ends of the coupling member 14 equal to the maximum diaphragm excursion desired, (which can substantially correspond to the depth of the speaker housing 16) and then, knowing the material and its elastic properties, the depth of the corrugations 28 can be chosen so as to allow for such desired excursion. In this regard, it is to be noted that by using polystyrene or other suitable plastic material, a full range speaker can be made having increased efficiencies at the low, mid and high range frequencies. The degree of flexibility in the axial direction provided by the coupling member 14 is preferably very high in order to provide for the desired frequency response, although, depending upon the particular requirements, the degree of flexibility can be varied, as is known in the art. In essence, the single compliant coupling member 14 serves to provide at least the same degree of compliance in the longitudinal direction as the prior art devices, and thus the principles on which such devices operate may also be applicable with respect to the present invention.

Figure 3:
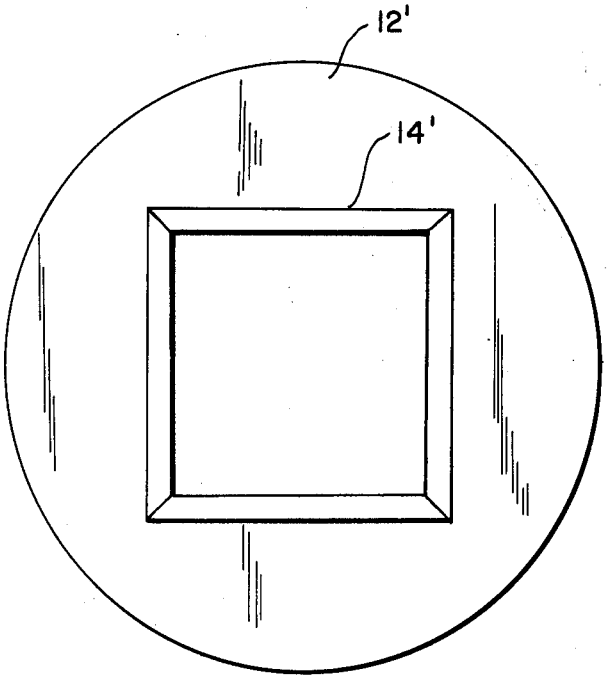
FIG. 3 is a rear plan view of an alternative embodiment for an acoustic diaphragm and compliant coupling for use in accordance with the present invention.

Further, it is to be realized that although the compliant coupling member 14 has a noncircular cross-sectional shape, which is rectangular in the preferred embodiment, this does not necessarily have to be the case with respect to the diaphragm 12. As best seen in FIG. 3, which is a rear elevational view of a diaphragm 12' and compliant support member 14', the diaphragm 12' may in fact be substantially circular in shape whereas the compliant support member 14' is square, in accordance with the principles of the present invention. Such a diaphragm 12' is particularly useful with a circular loudspeaker frame having an inside dimension slightly larger than the outer dimension of the diaphragm 12' to allow for maximization of the radiating area. Because of the noncircularity of the compliant coupling 14' which provides the lateral stability, the diaphragm 12' and compliant support member 14' shown in FIG. 3 again will allow free axial movement of the diaphragm 12' relative to a housing but will maintain the lateral position to maintain alignment of the voice coil (not shown) with the drive magnet assembly in the housing.

Of course, other arrangements for diaphragm shapes, including conical type diaphragms could be utilized with the compliant coupling member 14 in accordance with the present invention. Further, the particular size and shape of the corrugated compliant member 14 can also be varied in accordance with the broad principles of the present invention. For example, octagonal, hexagonal or other polygonal shaped of the cross-section could be utilized, and in fact, improved lateral stability will even be obtained with oval or elliptical shapes, as well as with irregular shapes. Further, it is to be noted that since the corrugated coupling member 14 extends only axially or longitudinally, the compliant coupling member 14 can be connected to the diaphragm 12 so as not to encroach upon the radiating area of the diaphragm 12.

Thus, it is seen that in accordance with the present invention, there is provided a sound reproducing assembly 10 including a housing 16, an acoustic diaphragm 12, a drive assembly 40 for driving the diaphragm and a corrugated compliant means 14 for supporting the diaphragm 12 with respect to the housing 16 in a predetermined lateral position for permitting longitudinal or axial movement relative thereto. The compliant means 14 has a noncircular lateral cross-sectional shape for aligning the diaphragm 12 laterally with respect to the housing 16.

While the preferred embodiments of the present invention has been shown and described, it will be understood that such is merely illustrative and that changes may be made without departing from the scope of the invention as claimed.

What is claimed is:

1. A sound reproducing device comprising:

a housing;

an acoustic diaphragm;

support means for supporting said acoustic diaphragm for substantially free longitudinal movement relative to said housing while maintaining said acoustic diaphragm in a predetermined lateral position relative to said housing, said support means comprising corrugated compliant coupling means having a lateral cross-sectional shape which is noncircular; and drive means for providing relative longitudinal movement between said acoustic diaphragm and said housing.

2. The sound reproducing device of claim 1 wherein said corrugated compliant coupling means has a lateral cross-sectional shape which includes a substantially linear portion.

3. The sound reproducing device of claim 2 wherein said corrugated compliant coupling means has a lateral cross-sectional shape of a polygon.

4. The sound reproducing device of claim 3 wherein said corrugated compliant coupling means has a lateral cross-sectional shape of a rectangle.

5. The sound reproducing device of claim 1 wherein said acoustic diaphragm includes a substantially planar front face, and a back face, and wherein said corrugated compliant coupling means comprises a corrugated compliant member having a first end connected to a portion of the back face of said acoustic diaphragm, and a second end connected to said housing.

6. The sound reproducing device of claim 5 wherein said first end of said corrugated compliant member is connected to the periphery of said back face of said acoustic diaphragm.

7. The sound reproducing device of claim 5 wherein said corrugated compliant member is substantially normal to the plane of said front face of said acoustic diaphragm.

8. The sound reproducing device of claim 6 or 7 wherein said drive means comprises a magnet assembly supported by said housing and having a longitudinally extending air gap, and a voice coil carried by said acoustic diaphragm arranged for longitudinal movement within said air gap to move said acoustic diaphragm longitudinally.

9. The sound reproducing device of claim 8 wherein said housing includes a rear wall, wherein said magnet assembly is mounted on said rear wall of said housing, wherein said voice coil is mounted on said back face of said diaphragm, and wherein said corrugated compliant member extends between said rear wall of said housing and said back face, and surrounds said voice coil and said magnet assembly.

10. The sound reproducing device of claim 1 wherein said acoustic diaphragm has a noncircular cross-sectional shape which corresponds to said noncircular cross-sectional shape of said corrugated compliant coupling means.

11. The sound reproducing device of claim 10 wherein said acoustic diaphragm and said corrugated compliant coupling means have rectangular cross-sectional shapes.

12. The sound reproducing device of claim 1 wherein said acoustic diaphragm has a lateral cross-sectional shape which is different from said lateral cross-sectional shape of said corrugated compliant coupling means.

13. The sound reproducing device of claim 12 wherein said acoustic diaphragm has a circular cross-sectional shape.

14. The sound reproducing device of claim 13 wherein said corrugated compliant coupling means has a rectangular cross-sectional shape.

15. The sound reproducing device of claim 1 wherein said compliant coupling means surrounds and encloses said drive means.

16. The sound reproducing device of claim 15 wherein said drive means is supported by said housing and wherein said compliant coupling means comprises a corrugated compliant member having a first end connected to said acoustic diaphragm and a second end connected to said housing and surrounding said drive means.

17. The sound reproducing device of claim 15 wherein said housing includes openings extending through said housing to lie within said second end of said corrugated compliant member, means for said openings for obstructing particulate entry into said housing through said openings while permitting free air flow therethrough.

18. In a sound reproducing device having a housing, an acoustic diaphragm, support means for supporting said acoustic diaphragm for substantially free longitudinal movement relative to said housing while maintaining said acoustic diaphragm in a predetermined laterial position relative to said housing, and means for driving the acoustic diaphragm longitudinally relative to said housing, the improvement comprising said support means comprising a corrugated compliant coupling having a noncircular lateral cross-sectional shape.

* * * * *